US005081979A

United States Patent [19]

Burling

[11] Patent Number: 5,081,979

[45] Date of Patent: Jan. 21, 1992

[54] FRONT PULL GRIP ASSEMBLY FOR ARCHERY BOW

[76] Inventor: Michael R. Burling, 7611 Holstein Rd., Toledo, Ohio 43617

[21] Appl. No.: 538,663

[22] Filed: Jun. 15, 1990

Related U.S. Application Data

[63] Continuation-in-part of Ser. No. 182,442, Apr. 18, 1988, Pat. No. 4,966,124.

[51] Int. Cl.[5] ..... F41B 5/00

[52] U.S. Cl. ..... 124/23.1; 124/88

[58] Field of Search ..... 124/88, 86, 23.1, 24.1

[56] References Cited

U.S. PATENT DOCUMENTS

| | | | |
|---|---|---|---|
| 2,854,965 | 10/1958 | Eberbach | 124/23.1 |
| 3,397,685 | 8/1968 | Walker | 124/24.1 |
| 3,407,799 | 10/1968 | Reynolds | 124/24.1 |
| 3,416,508 | 12/1968 | Thompson | 124/24.1 |
| 3,491,739 | 1/1970 | Scrobell | 124/23.1 |
| 3,517,658 | 6/1970 | Shurts | 124/23.1 |
| 3,538,902 | 11/1970 | Fowkes | 124/23.1 |
| 3,599,621 | 8/1971 | Scrobell | 124/23.1 |
| 3,814,074 | 6/1974 | Wood | 124/24.1 |
| 4,252,100 | 2/1981 | Rickard | 124/23.1 |
| 4,457,287 | 7/1984 | Babington | 124/23.1 |
| 4,881,514 | 11/1989 | Denslow et al. | 124/88 X |
| 4,966,124 | 10/1990 | Burling | 124/23.1 |

*Primary Examiner*—Peter M. Cuomo

*Attorney, Agent, or Firm*—Willian Brinks Olds Hofer Gilson & Lione

[57] ABSTRACT

A grip assembly for an archery bow installed on the riser of a bow to provide a frictionless pivot connection between the bow and the grip and which does not impart torque to the bow. Three styles of frictionless pivot connections are disclosed which include a pivot grip, a pull grip and a combination pull grip and pivot. The invention is adaptable to existing bows and may be installed by the user, or may be included by the manufacturer or the bow. The invention is adapted to several known styles of archer bows.

14 Claims, 5 Drawing Sheets

FRONT PULL GRIP ASSEMBLY FOR ARCHERY BOW

This is a continuation-in-part application Ser. No. 182,442, filed Apr, 18, 1988 (now U.S. Pat. No. 4,966,124).

SUMMARY OF THE INVENTION

In practicing archery, maintaining the bow in the line of the shot from the release of the bow string until the notch end of the arrow has passed the bow is critical to the accuracy of the shot. When the bow is drawn with no torque applied through the grip, the arrow direction and the sighting direction coincide. When torque is applied to a drawn bow, the arrow parallels the sighting direction, but the bow is aimed in the direction of the applied torque. This results in changing the direction of the bow, thereby effecting the accuracy of the shot.

It is, therefore, an object of this invention to provide a grip that is connected to the riser of the bow by a relatively frictionless pivot connection means and which does not impart torque to the bow during the shot. The various frictionless pivot connection means which have been tried and have achieved the purpose of the invention include either relatively sharply pointed pivot pin means, a spherical ball and bearing means, or a cable means (with a pull grip), as embodiments of the invention which will be further discussed hereinafter.

Further, the invention includes a pivot grip for a bow, a pull grip for a bow, or a combination (pull-pivot) grip for a bow, which the archer may install or have installed on existing styles of bow risers or on new bows, and which employ the principles of the invention. The superior results of the invention may be realized by using one of the grip devices hereinafter described.

And, since prior grips for the most part require a bow be designed and made specially for it, the grip of the present invention may be adapted and installed by the owner on most bows being manufactured at the present time.

In the accompanying drawings, there are illustrated various embodiments of the invention, including a preferred embodiment, and other objects and advantages of the invention will be apparent from the drawings and the following detailed description.

DETAILED DESCRIPTION

Figure 1:
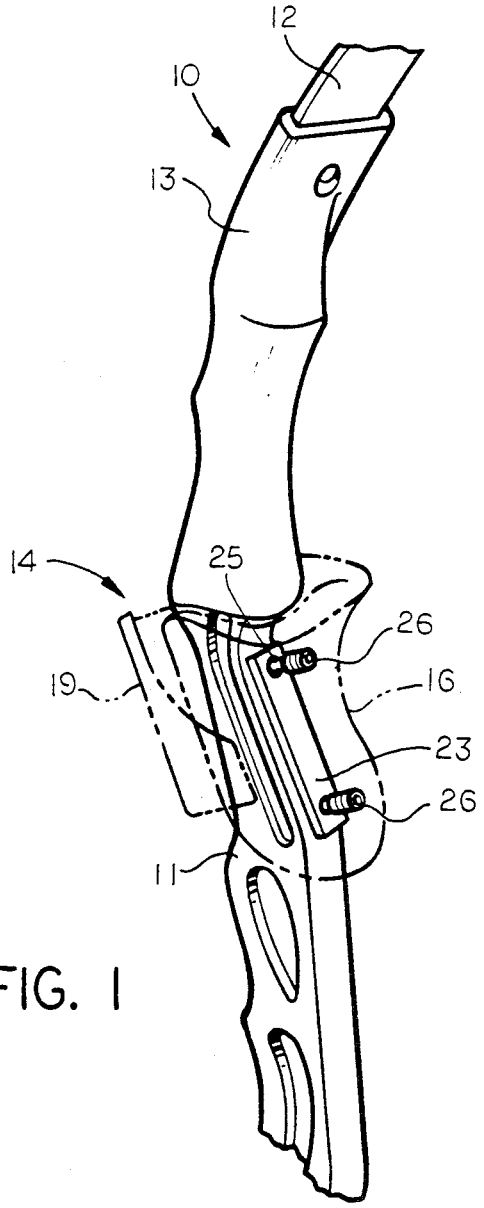
FIG. 1 is a partial view, in perspective, of an archery bow showing the grip assembly of the invention mounted on the riser of the bow.

On the drawings, FIG. 1 shows in part a compound archers bow 10 comprised of a central riser 11 and attached upper limb 12 and a lower limb (not shown). The riser and limb juncture is covered by a casing such as 13. The riser is made of metal alloy for strength and lightweight characteristics of the bow. The casing is molded of plastic.

The present invention is adaptable to a bow such as is illustrated in FIG. 1, however, will be usable with a wide variety of archery bows. In this disclosure, the style of bow illustrated is but one example of use of the invention.

Figure 2:
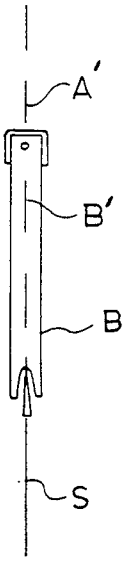
FIG. 2 is a schematic plan view of a bow, bow string and arrow showing the line of sight and line of flight of the arrow where both coincide for an accurate shot of the arrow in the line of sight.

FIG. 2 illustrates schematically the desired result of shooting an arrow in which the plane of bow B, of bow string S and the line of sight (and the plane of the arrow) A are in the common plane A'. This illustrates a condition in which there is zero torque applied to the bow. When a bow is drawn with no torque applied through the grip, the flight of the arrow and the line of sight will coincide.

Figure 3:
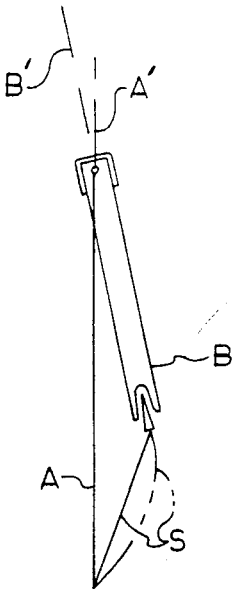
FIG. 3 is a schematic plan view like FIG. 2 but showing the effect of torque or rotation of the bow with respect to the line of the sight and line of flight of the arrow producing an inaccurate shot of the arrow.

Torque is applied by pivoting the plane of the bow displacing it at an angle from the line of sight. FIG. 3 illustrates schematically the condition when torque is applied to the drawn bow. The arrow and sight direction A are in the plane A'. The bow B is in the plane B' which is now, due to the torque or the archer's wrist, etc., directed right or left (depending whether the shooter is right or left-handed). This changes the direction of the arrow and influences the accuracy of the archer.

The invention herein disclosed remedies this by providing a frictionless pivot point between the grip of the bow and the riser. Pivoting of the grip will not impart torque to the bow and the characteristics of FIG. 2 are achieved resulting in the higher degree of accuracy.

The Pivot Grip Embodiment

Figure 5:
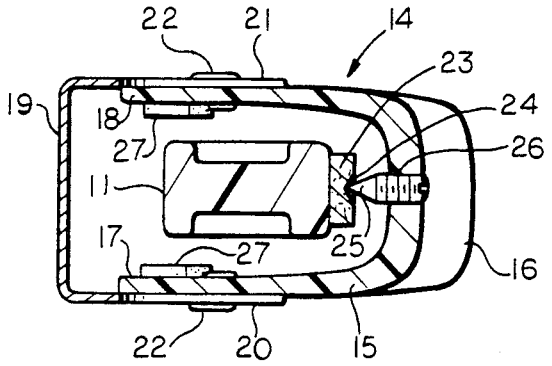
FIG. 5 is a sectional plan view along line 5—5 on FIG. 4.
Figure 4:
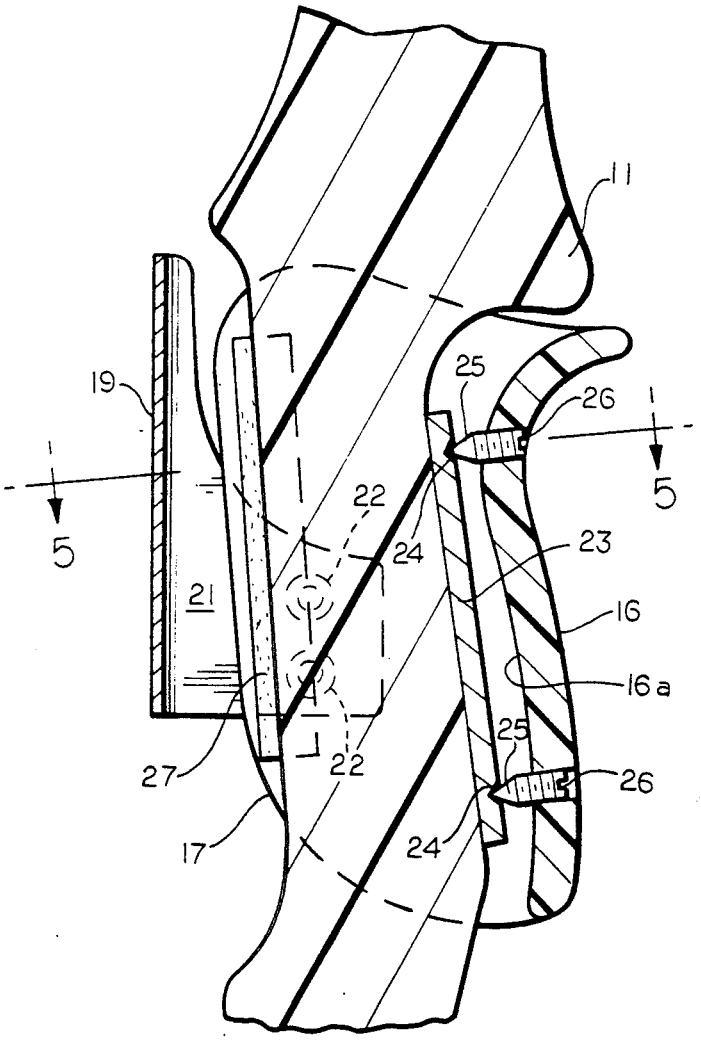
FIG. 4 is a sectional elevational view of the pivot grip embodiment of the invention.

In one form of the invention a "pivot grip" 14 is shown on FIGS. 1, 4 and 5, which comprises the hand grip 16 having a contoured back surface and sides 17 and 18 providing a clevis arrangement extending on either side of riser 11 of the bow. A U-shaped shield plate 19 is secured along its legs 20 and 21 to the sides 17 and 18, respectively, of the hand grip 16 by fasteners 22. The hand grip is preferably molded of plastic for appearance and contour, and the shield plate may be of plastic material or metal, etc.

As shown on FIG. 4, a bearing plate 23 is fastened to the back side (side nearest the archer) of the riser 11 by suitable means such as adhesive. Alternatively, bearing plate 23 may be incorporated in the bow riser design of the bow by the manufacturer. The present invention is versatile in that it may be added conveniently to existing bows by their owner/users.

Bearing plate 23 has two spaced-apart conical pivot seats 24 located on a vertical center line and the bearing plate is affixed on the vertical center of the bow. Pivot seats 24 provide an apex to receive pointed pivots 25 which are threaded and received in threaded apertures 26 through the back side of hand grip 16. The pivots 25 are sharper in contour than the apex of seats 24 which provide frictionless pivot points between the hand grip and the riser. In using the pivot grip assembly just described, the archer supports the bow by the bow string and the hand grip. The hand grip 16 is further provided with pads 27 of felt or like dampening material attached along the inside surface of each side walls 17 and 18. Pads 27 dampen any vibration of the hand grip against the riser after the bow string is released in the shot of an arrow.

Figure 6:
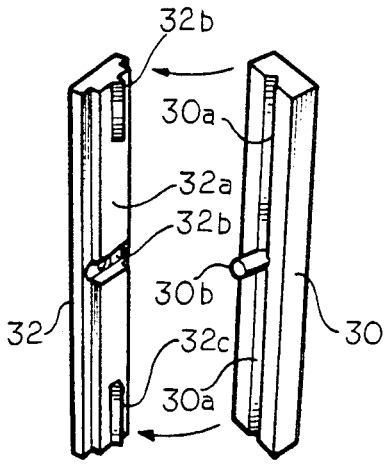
FIG. 6 is a perspective view of the bearing plate and pivots on the grip and riser, respectively, as used on another form of the invention.
Figure 7:
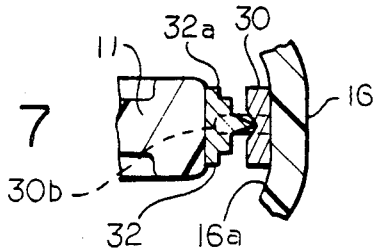
FIG. 7 is a fragmentary sectional plan view of the interengagement of the grip and bow riser illustrating one example of pivotal connection between them.

FIGS. 6 and 7 disclose a variant of the pivot grip embodiment in which an elongated member 30 is attached to the forward surface (away from the archer) 16*a* of the hand grip 16. An elongated plate member 32 is fastened and centered on the vertical center of the bow riser 11. Plate member 32 includes a longitudinally extending raised flat surface 32*a* narrower than the rear side base and longitudinally extending, spaced apart knife edges 32*b* and 32*c* protrude rearwardly of the riser. A central, elongated, oval slot 32*d* is provided in the rearward facing surface of member 32. The elongated member 30 fastened to the hand grip includes a central V-slot 30*a* extending centrally and vertically thereof in which the knife edges 32*b* and 32*c* each seat themselves for pivotal rocking movement. The centered forwardly projecting pin 30*b* protrudes from the member 30 and fits into elongated slot 32*d* of the member 32. Pin 30*b* is round, the major axis being disposed in the long dimension of slot 32*d*. Pin 30*b* retains the vertical position of the hand grip 16 on the bow riser 11 during shooting. The knife edges 32*b* and 32*c* are sharper in angularity than the angularity of V-groove 30*a* and serve as frictionless pivots in the lateral direction. In use, the hand grip 16 is moved along the riser until pin 30*b* is inserted in slot 32*d*, whereupon the knife edges 32*b* and 32*c* are in the V-slot 30*a*. In drawing the bow, the force is transferred from hand grip 16 to the bow riser by the knife edges 32*b* and 32*c* in slot 30*a*. This frictionless connection of the grip and bow avoids applying torque to the bow.

Figure 8:
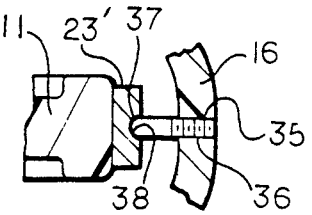
FIGS. 8-9 enlarged fragmentary views illustrating various types of relatively frictionless engagement connections between the riser of the bow and the grip.
Figure 9:
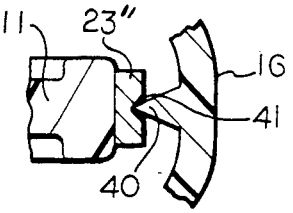
Figure 10:
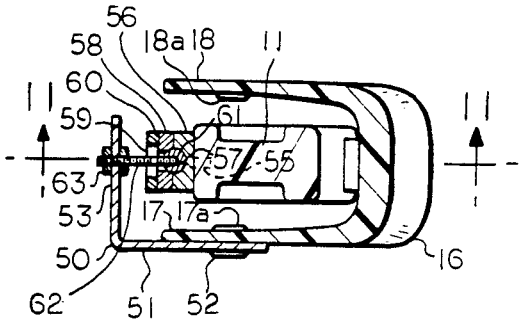
FIG. 10 is a sectional plan view showing a pull grip embodiment of the invention.

FIGS. 8–10 illustrate other variations which may be used in the pivot grip embodiment of the invention. The same reference numerals are applied to like parts.

In FIG. 8, an elongated bearing plate 23' is fastened on riser 11' similarly as described in FIG. 4. The hand grip 16 has a threaded aperture 35 and threaded pin 36 is assembled and held therein. The free end 37 of the pin is semispherical and it fits in a semispherical slot 38 in the bearing plate 23'. The radius of spherical surface 38 is larger than the radius of hemispherical pivot point 37 and the two engage to provide a frictionless pivot for the hand grip and riser to avoid applying torque during a shot.

FIG. 9 is a further variant of the pivot grip embodiment that is frictionless pivot connection. The hand grip 16 has a pivot point 40 formed on the back surface facing away from the archer. Pivot point 40 is made integral in the casting of hand grip 16 and machined. The bearing plate 23" is fastened to the near side of the riser 11, as previously described on FIG. 4. Bearing plate 23" has a conical seat 41 located on the vertical center of the bow, seat 41 being of greater angularity than the point 40. The engagement of point 40 in the seat 41 provides still another form of a frictionless pivot connection between the grip and riser.

The Pull Grip Embodiment

As distinguished from the pivot grip embodiment in which the drawing force on the bow is transmitted through the riser at the back side of the bow (side nearest the archer) to the hand grip. The pull grip embodiment has the drawing force on the bow transmitted through the front side of the riser (away from the archer) and to the hand grip.

Figure 11:
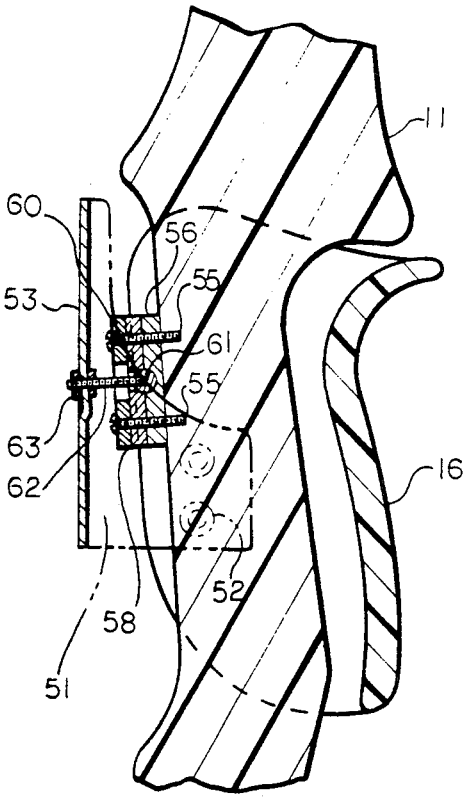
FIG. 11 is a sectional elevational view taken along line 11—11 on FIG. 10.

One form of this pull grip embodiment is shown on FIGS. 10 and 11. As explained earlier, similar parts are identified on the drawings by the same reference numerals.

The U-shaped hand grip 16 fits around the riser 11. A back plate 50 is assembled to one side or the other of hand grip 16 by cap screws 52 through side leg 51 and threaded in to the threaded inserts 17*a* of side 17 of the hand grip. As shown on the drawings, FIG. 10 is set up for a right-handed archer. As such, the side leg 51 of the back plate is always along the fingers side of the hand on the grip. If a left-handed shooter uses this embodiment, the back plate is placed along the side wall 18; or opposite that shown on FIG. 10. The front leg 53 of the back plate is disposed at a right angle to its leg 51 and extends in front of and across riser 11 of the bow. A socket member 56 is attached to the front of riser 11 by screws 55.

Socket member 56 is abutted on the riser and fastened to it by screws 55. Member 56 includes a central hemispherical socket portion defining a spherical cavity 57 that is centered along the vertical center of the bow. An intermediate plate 58 lies against plate 56 and further defines the spherical surface joined with an axial aperture 59 extending off the center of the sphere 57. Plate 58 is made of a material having a low coefficient of friction, such as Teflon. A cover plate 60 is used to receive the screws 55 and fasten the assembly onto the riser. A spherical ball 61 is threaded on the end of bolt 62 which extends through aperture 59 of the socket member and through a hole in the front leg 53 of back plate 50. The bolt is secured and adjusted in place by the lock nuts 63. Ball 61 is fitted and sized with the socket 57 to operate like a ball bearing in a semispherical race and as such provides a frictionless connection means between the hand grip and bow riser which avoids transmitting torque to the bow from the draw of the archer.

In the pull grip just discussed, the archer draws the bow applying resistance or holding pressure on the back side of the hand grip. This force is transmitted by the grip to the back plate 50 and into the ball that is within the socket assembly, this force going primarily from the ball surface onto the spherical socket surface of the assembly that is attached to the riser. By the frictionless connection supplied by the spherical ball and socket, torque in the hand grip will not be applied to the bow riser.

Figure 16:
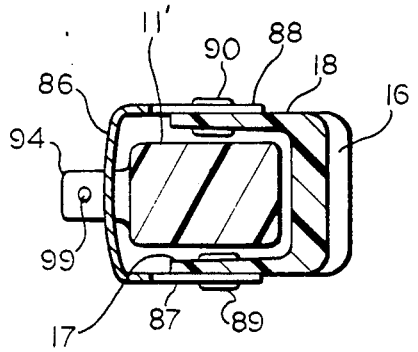
FIG. 16 is a sectional plan view taken along line 16—16 on FIG. 15.
Figure 17:
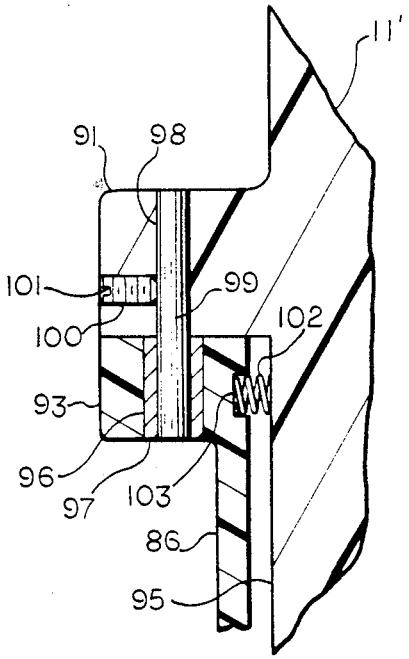
FIG. 17 is an enlarged fragmentary sectional view of the pin pivot for the front pull grip.
Figure 15:
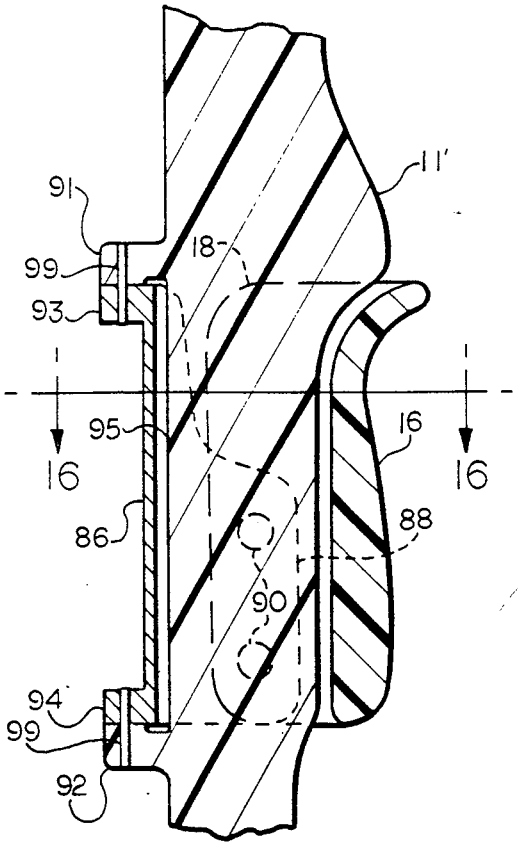
FIG. 15 is a sectional elevational view of another front pull embodiment of the pull grip.

Referring to FIGS. 15–17 another form of pull grip embodiment of the invention is shown. Similar parts are identified on the drawings by the same reference numerals used on the embodiment of FIGS. 10 and 11.

The U-shaped hand grip 16 fits around the riser 11'. A back plate 8 is generally U-shaped in section (FIG. 16) and has sides 87 and 88 which overlap the outer surfaces of the sides 17 and 18 of grip 16. The back plate also serves as a shield plate and has a low friction pivotal connection to the front of the riser element 11' of the bow. The side 87 of the back plate is fastened by rivet 89 to side 17 of the hand grip and side 88 of the back plate is fastened by rivet 90 to side 18. In this fashion, the hand grip 16 and back plate 86 encircle the riser.

Riser 11' includes spaced apart front mounting brackets 91 and 92 and the back plate 86 is connected to riser 11' by a protruding top segment 93 and a protruding bottom segment 94. Top and bottom segments 93 and 94 are molded with the back plate 86 and are aligned along the front surface 95 of the riser to lie in the plane of the bow. Each protruding segment 93 and 94 have a journal 96 bored vertically (see FIG. 17). The axes of the bored journals 96 are aligned and are in the vertical plane of the riser and the bow. Each of the (top and bottom) journals 96 are provided with fixed bearings 97 secured therein. The mounting brackets 91 and 92 of the riser each have a bored hole 98 and the holes 98 align with one another and receive a pivot pin 99. A threaded passage 100 is open at the front face of each of brackets 91 and 92 and set screw 101 is tightened against the pin 99 to hold it in place. Pin 99 is free to rotate in the bearing 97. There is clearance between the near surface of back plate 86 and riser front surface 95, and the U-shaped back plate only contacts the riser through the pivot pins 99 held thereby.

The top and bottom pins 99 secure the grip and shield plate assembly to the riser through the mounting bracket construction, just described. The hand grip rotates on the pins.

As an optional feature, a coil spring 102 may be inserted and held at notch 103 on the back surface of the back plate 86 (see FIG. 17). This spring 102 is added for hunting only to help silence the grip. Without the spring, the grip assembly is free to rattle. The size of spring selected is large enough in diameter and strength to resist free movement of the grip, but weak enough to only allow minimal or negligible torque transfer through it.

The riser 11' may be manufactured with the upper and lower mounting brackets 91 and 92 formed integrally, or the mounting brackets may be attached by suitable means onto existing bows.

Yet another form of pull grip embodiment of the invention is shown on FIGS. 18–21. This construction uses a similar system of pivot screw and semispherical slot as is exemplified by the pivot grip embodiment (shown on FIG. 8). The grip 16 is fastened to the U-shaped back plate 86' by rivets 90 at the overlapping sides, respectively. The front of the back plate is formed with top and bottom rearwardly directed segments 104 and 105 each of which include semispherical surface 106 protruding toward the surface 95' of the riser (see FIGS. 19–21). Top and bottom mounting brackets 107 and 108 are formed with or attached to the riser front 95' and each mounting bracket 107 and 108 has a threaded aperture 109 extending through the depending leg 110 of each of the brackets. An adjustable pivot pin 111 is threaded in aperture 109 and pin 111 includes a narrow point 112 that is semispherical and has a small radius at its end. The top and bottom segments 104 and 105 each have an arcuate, rearwardly facing surface 106 that is opposite the front surface 95' of the riser and is adjusted to be slightly spaced therefrom. The opposite and forwardly facing surface of each of segments 104 and 105 have a socket that includes a V-shaped notch 113 to receive the point 112 of pivot pin 111. There is clearance between the surface 106 and the riser surface 95' which restricts rearward movement of the grip assembly. The point 112 of the pivot pin is seated in notch 113 and restricts forward movement of the grip assembly. The center of the arcuate surface 106 (see section view FIG. 21) will be the center of rotation on the pivot point 112. This will maintain the same clearance between the back plate 86' and the riser as the grip assembly pivots back and forth.

The mounting brackets 107 and 108 are opposite and oppose each other along the front of the riser and may be integrally formed in the riser or may be added thereto by suitable attachment means. There is a spacing 114 provided in each behind leg 110 of the mounting brackets 107 and 108 providing enough clearance to allow installation and removal of the back plate 86'.

Figure 21:
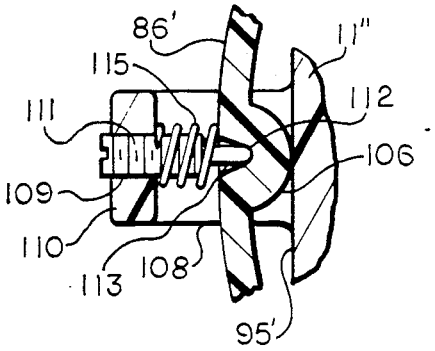
FIG. 21 is a sectional plan view taken along line 21—21 on FIG. 20.
Figure 19:
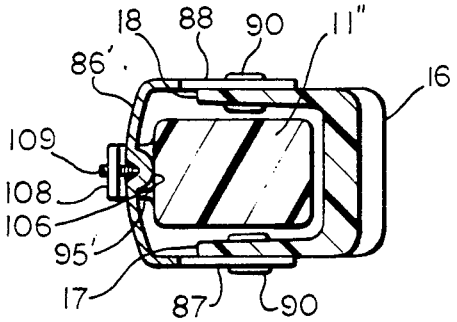
FIG. 19 is a sectional plan view taken along line 19—19 on FIG. 18.
Figure 20:
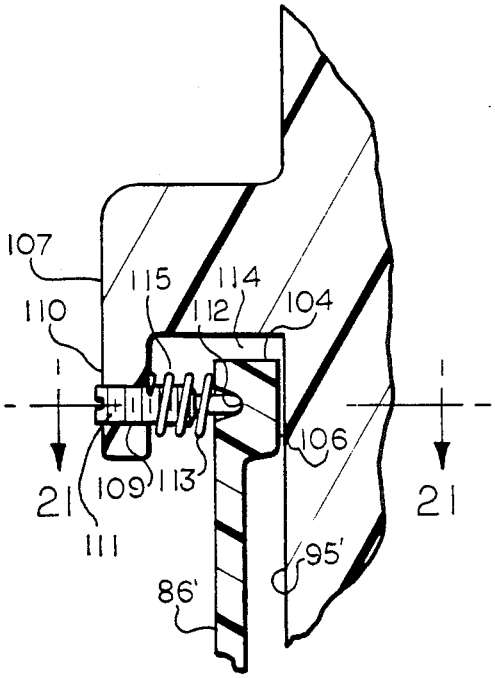
FIG. 20 is an enlarged fragmentary sectional view of pivot connection between the back plate of the pull grip and the riser.
Figure 18:
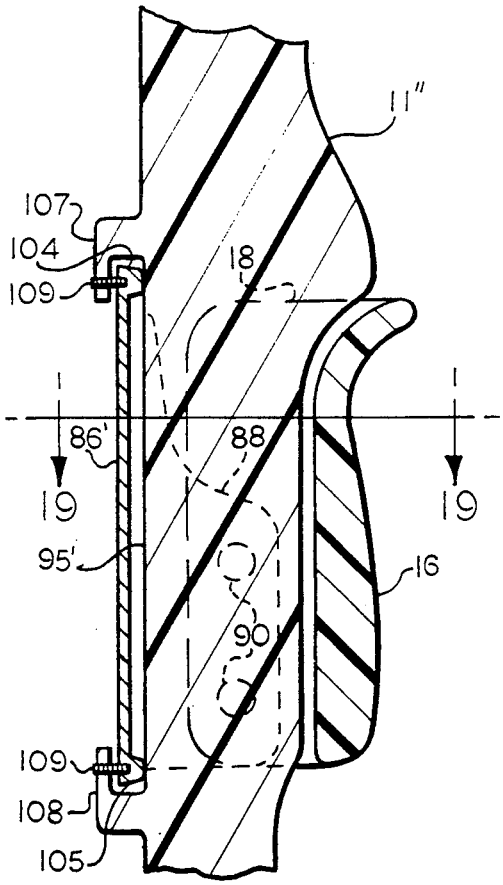
FIG. 18 is a sectional elevational view of still another front pull embodiment of the pull grip.

As shown on FIGS. 20 and 21 there is a spring 115 which may be optionally added when using the bow for hunting. The spring 115 reduces noise of shooting the bow, however, for target shooting or the like the spring 115 may be omitted. Spring 115 would be selected for size and strength, as was discussed earlier in this case on FIG. 17, to allow only minimal or negligible torque transfer from the grip assembly to the bow.

The Combination Grip

Figure 12:
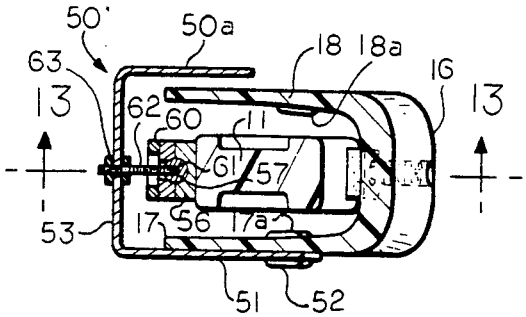
FIG. 12 is a sectional plan view like FIG. 11 showing another form of the pull grip.
Figure 13:
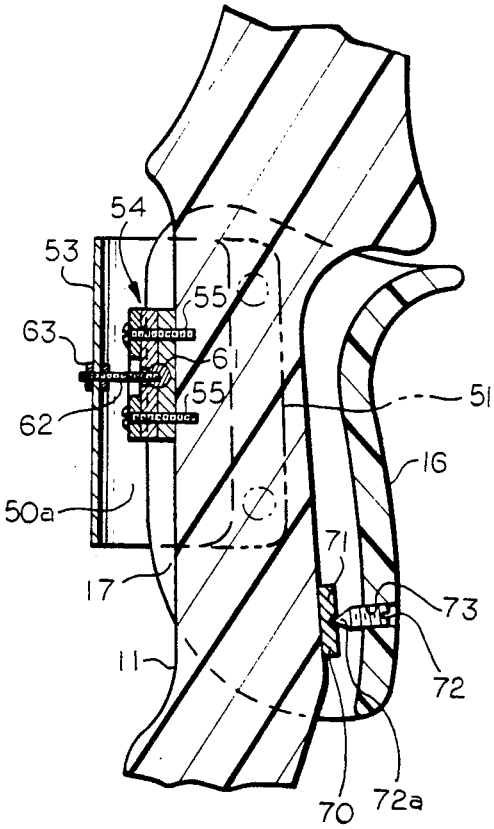
FIG. 13 is a sectional elevational view taken along line 13—13 on FIG. 12.

Within the principles of the invention, a third embodiment is presented and illustrated on FIGS. 12 and 13. The pull grip is attached according to the description of FIGS. 10 and 11. The same procedure is provided in this form of the invention in which the fingers of the right-handed archer will lie along the side leg 51 of the back plate 50. An opposite side **50*a* extends at a right angle from the front leg 53 to surround the inner end of the hand grip and side 50*a* is spaced from the side 18 of hand grip 16. The leg 50*a*** is a support bracket which shields the riser from contact of the hand and fingers.

As was described under FIGS. 10 and 11, the back plate 50 may be reversed for a left-handed archer. Removing the cap screws 52 and lock nuts 63, the back plate may be revolved 180° and screws 52 inserted into the threaded inserts **18*a* in the side 18 of the hand grip. The bolt 62 is again inserted through the aperture of front leg 53 and the lock nuts 63** reapplied.

A bearing plate 70 is attached at the back of riser 11 and includes a conical seat 71 on its exposed surface. A set screw 72 is inserted in a threaded aperture 73 through hand grip 16. The plate 70 is located on the vertical center of the bow and vertically below the socket 57 of the member 54 so that it and the conical seat 71 are aligned on the vertical center of the bow. The combination of the spherical ball 61 and spherical socket 57 provide the principal frictionless pivot connection between the hand grip and the riser, plus the point 72*a* of the set screw 72 in conical seat 71 provides a stabilizing contact between the back side of the riser and the hand grip.

Figure 14:
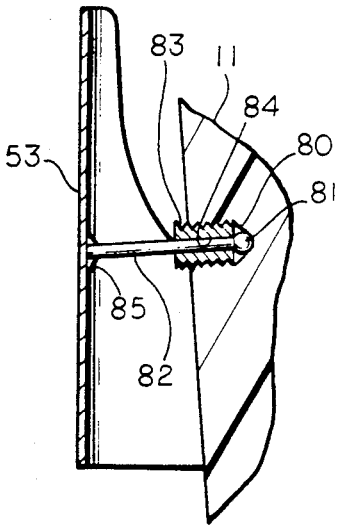
FIG. 14 is a fragmentary elevational view showing another variation of the pull grip.

Another variant form of the invention is shown on FIG. 14. This provides a connection between the back plate 53 and the riser 11. A hole 80 is tapped and threaded in the front surface of the riser along the Vertical center of the bow. The inner end of hole 80 provides some clearance to contain the bead 81 on the end of flexible member 82 which may be in the form of a flexible cable with an internal enlargement at the inner end. A threaded plug 83 is screwed into the thread of hole 80 with the cable 82 extending through a center aperture 84 of plug 83. The outer end of cable 82 is attached to a snap-in fitting 85 on the inner surface of the back plate 53. Cable 82 is provided to the correct length for attaching the hand grip in the fashion shown on either the pull grip of FIG. 11 or the combination grip of FIG. 13. In this form, the connection between the hand grip and the riser is frictionless by reason of the flexibility of cable 82.

The pivot grip, pull grip or combination grip embodiments herein described provide an added advantage to the archer. By rotating the grip assembly clockwise while pulling the bow string, the archer can gain more clearance between his arm and the path of the bow string.

The term "vertical center" and "vertical plane" of the bow as used in the description of the invention is intended to mean the longitudinal center or longitudinal axis thereof assuming the bow is used in a vertical attitude when shooting an arrow.

The term "frictionless connection" as used in the description is intended to mean a connection by which no torque can be transmitted from the one member to the other member connected to it.

The invention has been shown and described herein in several embodiments and variations thereof. It is recognized, however, that departures may be made therefrom including modifications apparent to a person skilled in the art which are within the scope of the invention as defined by the appended claims.

What is claimed is:

1. In an archery bow having a central riser element and upper and lower limbs extending therefrom in the plane of the bow, the combination therewith of:

a grip assembly comprising a hand grip having a back surface nearest the archer and at the back side of the riser element, the hand grip having depending sides spaced on either side of the riser element, a U-shaped back plate element secured to said hand grip and extending across the front of the riser element, said back plate element and said hand grip together substantially encircling the riser element, a low friction pivotal connection means between said back plate element and said riser element comprising a pin member fastened to one of said elements, and a pivot member on the other of said elements, said pin member engaging said pivot member for pivotal movement without imparting torque from the hand grip to the riser element;

wherein said pivot member is on the forward side of the riser element facing away from the archer and the pin member is fastened to the back plate element.

2. The archery bow of claim 1 wherein the pivot member comprises a socket connected on the riser element and the pin member includes a ball engaging said socket.

3. The archery bow of claim 2 wherein the socket member is detachably connected on the riser.

4. The archery bow of claim 2 wherein the pin member comprises a flexible cable having its one end secured in said socket member and its other end secured on the back plate element, the pivoting movement being provided by flexing said cable.

5. A grip assembly for an archery bow having a central riser member having front and rear sides extending in the plane of the bow comprising a hand grip member at the rear side of the riser member and adapted to at least partially encircle the riser member, said hand grip member including a back plate extending across the front side of the riser element, a socket means disposed at the front side of the riser member and attached to one of said members, a pivot attached to the other of said members and engaging the socket means, said socket means and pivot providing pivotal movement of the hand grip member relative to the riser member without transmitting torque;

wherein said socket means comprises a spherical seat, and said pivot comprises a bolt having a spherical ball at one end engageable with said spherical seat for said pivotal movement, the other end of said bolt being attached to said back plate.

6. In an archery bow having a central riser element and upper and lower limbs extending therefrom in the plane of the bow, the combination therewith of:

a grip assembly comprising a hand grip having a back surface nearest the archer and depending sides providing a clevis arrangement extending around opposite sides of the riser element, a back plate element having sides and extending in front of the riser element, means connecting the back plate element to the hand grip, a frictionless connection means between said back plate element and riser element comprising a pivot member connected to one of said elements and a pivot seat connected to the other of said elements, said pivot seat and said pivot member being disposed at the front of the riser element, said connection means providing a low friction contact so as to avoid imparting torque from the hand grip to the riser;

wherein said pivot member is connected to the back plate element and the pivot seat is connected to the riser element, and wherein said pivot member comprises a flexible member having an enlargement at one end and the pivot seat comprises a means anchoring said enlargement of the flexible member.

7. In an archery bow having a central riser element and upper and lower limbs extending therefrom in the plane of the bow, the combination therewith of:

a grip assembly comprising a hand grip having a back surface nearest the archer and depending sides providing a clevis arrangement extending around opposite sides of the riser element, a back plate element having sides and extending in front of the riser element, means connecting the back plate element to the hand grip, a frictionless connection means between said back plate element and riser element comprising a pivot member connected to one of said elements and a pivot seat connected to the other of said elements, said pivot seat and said pivot member being disposed at the front of the riser element, said connection means providing a low friction contact so as to avoid imparting torque from the hand grip to the riser;

wherein said pivot member is connected to the riser element and the pivot seat is connected to the back plate element, wherein said pivot seat comprises bearing means, the pivot member comprises pivot pin means being rotatable in said bearing means, said pivot pin means being connected on the riser element with its axis in the plane of the bow, and rotatable in said bearing means, and said bearing means being connected to the back plate, and wherein said pivot pin means comprises two spaced-apart, coaxial pivot pins, and said bearing means comprises two bearings coaxially mounted on said back plate to receive said pivot pins.

8. In an archery bow having a central riser element and upper and lower limbs extending therefrom in the plane of the bow, the combination therewith of:

a grip assembly comprising a hand grip having a back surface nearest the archer and depending sides providing a clevis arrangement extending around opposite sides of the riser element, a back plate element having sides and extending in front of the riser element, means connecting the back plate element to the hand grip, a frictionless connection means between said back plate element and riser element comprising a pivot member connected to one of said elements and a pivot seat connected to the other of said elements, said pivot seat and said pivot member being disposed at the front of the riser element, said connection means providing a low friction contact so as to avoid imparting torque from the hand grip to the riser;

wherein said pivot member is connected to the riser element and the pivot seat is connected to the back plate element, wherein said pivot member comprises pin means connected on the riser with its axis normal to the plane of the bow, and the pivot seat comprises a V-notch on the back plate.

9. The combination of claim 8 which includes an arcuate surface on the back plate opposite said V-notch, said arcuate surface being disposed adjacent the front of said riser element.

10. The combination of claim 8 in which said pin is adjustably threaded on the riser.

11. The combination of claim 8 in which the pin means includes two pins spaced apart on the riser element in the plane of the bow.

12. In an archery bow having a central riser element and upper and lower limbs extending therefrom in the plane of the bow, the combination therewith of:

a grip assembly comprising a hand grip having a back surface nearest the archer and depending sides providing a clevis arrangement extending around opposite sides of the riser element, a back plate element having sides and extending in front of the riser element, means connecting the back plate element to the hand grip, a frictionless connection means between said back plate element and riser element comprising a pivot member connected to one of said elements and a pivot seat connected to the other of said elements, said pivot seat and said pivot member being disposed at the front of the riser element, said connection means providing a low friction contact so as to avoid imparting torque from the hand grip to the riser;

wherein said frictionless connection means comprises a back plate fastened to a side of the hand grip and extending in front of the riser element opposite the archer, a rod fastened to said back plate and extending rearwardly toward said riser element in the plane of the bow, a ball on the end of said rod, and a spherical seat fastened to the front of the riser element and centered on the plane of the bow, said seat holding said ball for swiveling movement therein.

13. The combination of claim 12 which includes a pivot seat on the back of the riser element located in the plane of the bow, and a pivot point on the back surface of the hand grip opposite the pivot seat, said pivot point and pivot seat maintaining lateral torque on the hand grip independent of the riser and preventing rotation of the hand grip with respect to the riser element in the plane of the bow.

14. In an archery bow having a central riser element and upper and lower limbs extending therefrom in the plane of the bow, the combination therewith of:

a grip assembly comprising a U-shaped hand grip element having a back surface nearest the archer and depending sides extending in spaced relationship on opposite sides of the riser element and shielding the archer's hand from the riser element, a frictionless connection means between the hand grip element and the riser element, said frictionless connection means comprising a back plate fastened to the hand grip element and extending in front of the riser opposite from the archer, and a flexible member fastened at its one end to said back plate and at its other end to the front of the riser element in the plane of the bow, said flexible member maintaining lateral torque application on the hand grip element independent of the riser, wherein said flexible member is a flexible cable.

* * * * *